US008819920B2

(12) United States Patent
Yoon et al.

(10) Patent No.: US 8,819,920 B2
(45) Date of Patent: Sep. 2, 2014

(54) METHOD OF MANUFACTURING STACKED RESONATED COIL

(75) Inventors: Young Seok Yoon, Gyunggi-do (KR); Eung Ju Kim, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 173 days.

(21) Appl. No.: 13/605,807

(22) Filed: Sep. 6, 2012

(65) Prior Publication Data

US 2013/0074321 A1 Mar. 28, 2013

(30) Foreign Application Priority Data

Sep. 27, 2011 (KR) ..... 10-2011-0097799

(51) Int. Cl.
*H01F 7/06* (2006.01)

(52) U.S. Cl.
USPC ..... 29/602.1; 29/825; 29/829; 29/846

(58) Field of Classification Search
USPC ..... 29/602.1, 25.42, 825, 829, 832, 846; 340/571, 572.1, 572.5, 572.7, 572.8
See application file for complete search history.

(56) References Cited

U.S. PATENT DOCUMENTS 6,313,747 B2 * 11/2001 Imaichi et al. ..... 340/572.5
7,498,948 B1 * 3/2009 Gudeman et al. ..... 340/572.8

* cited by examiner

*Primary Examiner* — Thiem Phan
(74) *Attorney, Agent, or Firm* — Ladas & Parry, LLP

(57) ABSTRACT

Disclosed herein is a method of manufacturing a stacked resonant coil, the method including: (A) forming circuit layers on a plurality of double-sided FCCLs, respectively, and then stacking the double-sided FCCLs respectively having the circuit layers formed thereon; (B) forming first and second conductive via holes in the stacked plurality of double-sided FCCLs, the first conductive via hole being for interlayer connection of the first ends respectively formed in the circuit layers and the second conductive via hole being for interlayer connection of the first electrode patterns respectively formed in the circuit layers; and (C) forming a wiring layer on an external layer of an uppermost double-sided FCCL in the staked plurality of double-sided FCCLs, the wiring layer electrically connecting the first ends and the first electrode patterns, thereby improving mass-productivity of products having uniform performances and excellent quality.

12 Claims, 4 Drawing Sheets

METHOD OF MANUFACTURING STACKED RESONATED COIL

CROSS REFERENCE TO RELATED APPLICATION

This application claims the benefit of Korean Patent Application No. 10-2011-0097799, filed on Sep. 27, 2011, entitled "Method of Manufacturing Stacked Resonant Coil", which is hereby incorporated by reference in its entirety into this application.

BACKGROUND OF THE INVENTION

1. Technical Field

The present invention relates to a method of manufacturing a stacked resonant coil.

2. Description of the Related Art

Recently, wireless charging technologies employing magnetic induction have been promptly driven and products thereof have been quickly distributed.

In the existing magnetic induction type wireless charging device, a resonant coil pattern is formed by using a flexible PCB such that a plurality of continuous closed loops are provided at the time of manufacturing a resonant coil transmitting and receiving wireless power.

Here, first and second ends of the resonant coil pattern of the flexible PCB make a closed loop. The first and second ends need to be respectively connected with a battery rectification circuit, and thus need to be connected to positive/negative terminals (hereinafter, first and second electrode terminals).

For achieving this, at the time of manufacturing the existing resonant coil, an end disposed within the closed loop of the resonant coil pattern, (e.g., the first end) and one of the first and second electrode terminals (e.g., the first electrode terminal) were wired by using a conductive connection member such as a copper-clad tape, for electric connection.

However, according to the method of manufacturing the resonant coil of the prior art, after manufacturing the PCB, the end and the electrode need to be manually connected by using the copper-clad tape and soldering needs to be performed for each connection.

Therefore, the method of manufacturing a resonant coil according to the prior art may cause a high defect-occurrence rate at the time of handling, due to manual labor, and thus, make it difficult to mass-produce the resonant coil having uniform performances and excellent product qualities.

SUMMARY OF THE INVENTION

The present invention has been made in an effort to provide a method of manufacturing a stacked resonant coil by stacking resonant coils using a plurality of double-sided FCCLs and wiring ends of the resonant coils and an electrode terminal through conductive via holes.

According to a preferred embodiment of the present invention, there is provided a method of manufacturing a stacked resonant coil, the method including: (A) forming circuit layers on a plurality of double-sided FCCLs, respectively, and then stacking the double-sided FCCLs respectively having the circuit layers formed thereon by using a first adhesive, each of the circuit layers including a coil pattern, first and second ends of the coil pattern, a first electrode pattern, and a second electrode pattern formed integrally with the second end; (B) forming first and second conductive via holes in the stacked plurality of double-sided FCCLs, the first conductive via hole being for interlayer connection of the first ends respectively formed in the circuit layers and the second conductive via hole being for interlayer connection of the first electrode patterns respectively formed in the circuit layers; and (C) forming a wiring layer on an external layer of an uppermost double-sided FCCL in the staked plurality of double-sided FCCLs, the wiring layer connecting between the first and second conductive via holes for electrically connecting the first ends and the first electrode patterns.

The stage (A) may include: (A-1) etching a first surface of a first double-sided FCCL to form a first circuit layer including a coil pattern, first and second ends of the coil pattern, a first electrode pattern, and a second electrode pattern formed integrally with the second end; (A-2) etching a second surface of a second double-sided FCCL to form a second circuit layer corresponding to the first circuit layer, the second circuit layer including a coil pattern, first and second ends of the coil pattern, a first electrode pattern, and a second electrode pattern formed integrally with the second end; and (A-3) disposing the first adhesive between the first and second circuit layers, followed by pressing.

The stage (B) may include: (B-1) forming the first conductive via hole for interlayer connection of the first ends respectively formed in the circuit layers of the stacked plurality of double-sided FCCLs; and (B-2) forming the second conductive via hole for interlayer connection of the first electrode patterns respectively formed in the circuit layers of the stacked plurality of double-sided FCCLs.

The stage (C) may include: (C-1) plating insides of the first and second conductive via holes; (C-2) plating the external layer of the uppermost double-sided FCCL and an external layer of a lowermost double-sided FCCL in the stacked plurality of double-sided FCCLs, to thereby form first and second plating layers; and (C-3) etching the first plating layer and the external layer of the uppermost double-sided FCCL such that the first and second conductive via holes are connected to each other, to thereby form the wiring layer crossing from the first conductive via hole to the second conductive via hole.

The stage (C) may further include, (C-4) etching the second plating layer and the external layer of the lowermost FCCL to thereby form a circuit layer including a coil pattern, first and second ends of the coil pattern, a first electrode pattern, and a second electrode pattern formed integrally with the second end.

The method may further include, (D) forming an insulating layer on the wiring layer, the insulating layer protecting the wiring layer and preventing oxidation of the wiring layer.

The stage (D) may include, disposing a second adhesive on the wiring layer, and disposing an insulating material on the second adhesive layer, followed by pressing. The insulating material may be polyimide.

The stage (D) may include, coating a solder resist on the wiring layer. The solder resist may be a photoresist.

The first and second conductive via holes may be formed by a mechanical drilling process. The mechanical drilling process may be performed by computer numerical control drilling.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
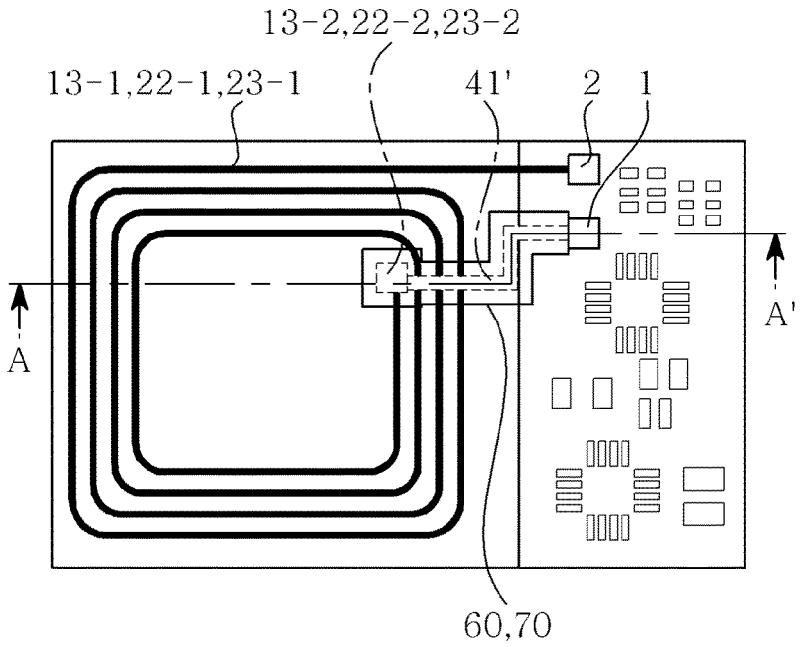
FIG. 1 is a top view of a stacked resonant coil according to a preferred embodiment of the present invention.

The objects, features and advantages of the present invention will be more clearly understood from the following detailed description of the preferred embodiments taken in conjunction with the accompanying drawings. Throughout the accompanying drawings, the same reference numerals are used to designate the same or similar components, and redundant descriptions thereof are omitted. Further, in the following description, the terms "first", "second", "one side", "the other side" and the like are used to differentiate a certain component from other components, but the configuration of such components should not be construed to be limited by the terms. Further, in the description of the present invention, when it is determined that the detailed description of the related art would obscure the gist of the present invention, the description thereof will be omitted.

Hereinafter, preferred embodiments of the present invention will be described in detail with reference to the attached drawings.

Figure 2:
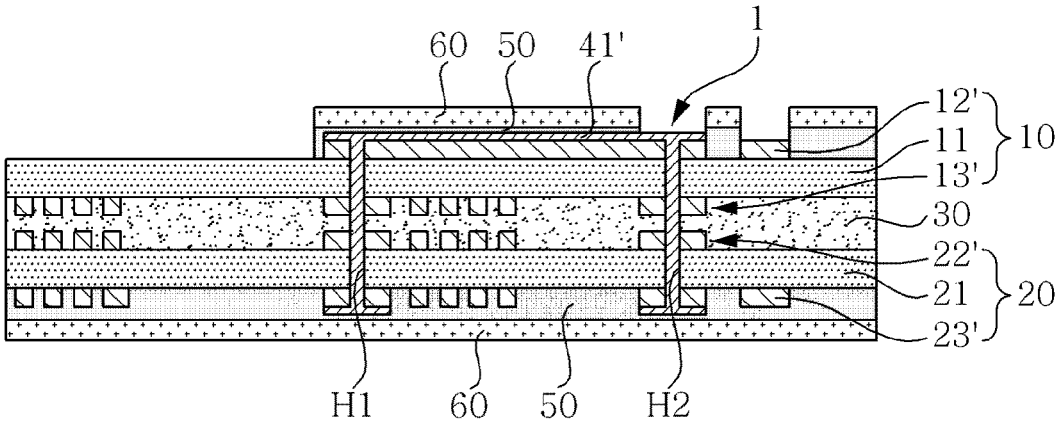
FIG. 2 is a view showing one example of the cross-section cut along the line A-A' of FIG. 1.

FIG. 1 is a top view of a stacked resonant coil according to a preferred embodiment of the present invention; FIG. 2 is a view showing an example of a cross-section cut along the line A-A' of FIG. 1; and FIG. 3 is a view showing another example of the cross-section cut along the line A-A' of FIG. 1.

Figure 3:
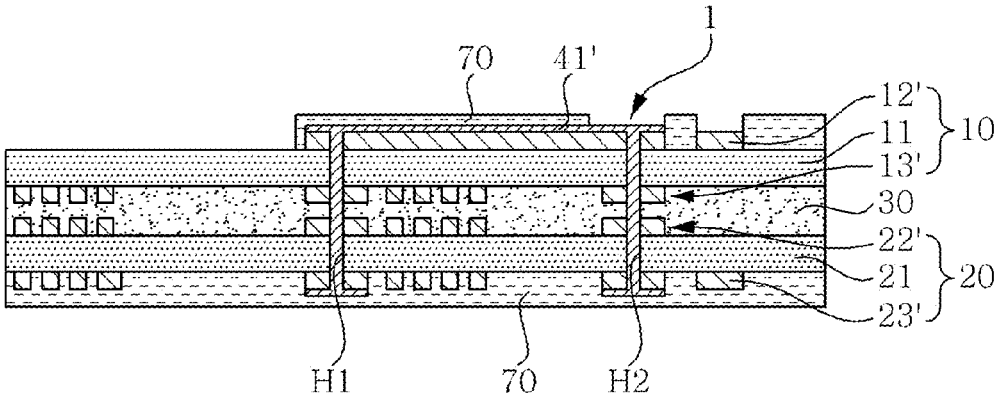
FIG. 3 is a view showing another example of the cross-section cut along the line A-A' of FIG. 1.

Referring to FIGS. 1 to 3, a stacked resonant coil according to a preferred embodiment of the present invention may include coil patterns 13-1, 22-1, and 23-1, which are formed in a plurality of continuous closed loops in respective layers of a plurality of double-sided FCCLs 10 and 20 and then stacked; first ends 13-1, 22-2, and 23-2, which are disposed in an inside space of the plurality of continuous closed loops of the coil patterns 13-1, 22-1, and 23-1 of the respective layers; first electrode patterns 13-3, 22-3, and 23-3, which are disposed outside the plurality of continuous closed loops of the coil patterns 13-1, 22-1, and 23-1 of the respective layers and spaced apart from the first ends 13-2, 22-2, and 23-2; and a wiring layer 41' electrically connecting the first ends 13-2, 22-2, and 23-2 and the first electrode patterns 13-3, 22-3, and 23-3.

In the stacked resonant coil according to the present invention, in order to stack the coil patterns 13-1, 22-1, and 23-1, the first ends 13-2, 22-2, and 23-2, and the first electrode patterns 13-3, 22-3, and 23-3 of the respective layers, circuit layers 13' and 22' including the coil patterns 13-1 and 22-1 formed in a plurality of continuous closed loops, the first ends 13-2 and 22-2, and the first electrode patterns 13-3 and 22-3 are respectively formed on the double-sided FCCL 10 and 20, and then a first adhesive 30 is disposed between the double-sided FCCL 10 and 20, and then pressed.

The use of two double-sided FCCLs 10 and 20 is shown, but the present invention is not limited thereto. For example, a plurality of double-sided FCCLs are used to stack a plurality of circuit layers.

In addition, the stack resonant coil according to the present invention may further include first and second conductive via holes H1 and H2.

Here, the first conductive via hole H1 is formed by drilling a portion where the first ends 13-2, 22-2, and 23-2 of the respective layers are stacked, through a mechanical drilling process, for interlayer connection among the first ends 13-2, 22-2, and 23-2 of the respective layers.

In a similar manner, the second conductive via hole H2 is formed by drilling a portion where the first electrode patterns 13-3, 22-3, and 23-3 of the respective layers are stacked, through a mechanical drilling process, for interlayer connection among the first electrode patterns 13-3, 22-3, and 23-3 of the respective layers.

The first ends 13-2, 22-2, and 23-2 of the respective layers may be interlayer-connected through the first conductive via hole H1, and the first electrode patterns 13-3, 22-3, and 23-3 of the respective layers may be interlayer-connected through the second conductive via hole H2.

The wiring layers 41' is formed on an outer layer of the uppermost double-sided FCCL (e.g., the first double-sided FCCL 10) of the plurality of double-sided FCCLs, while crossing the first conductive via hole H1 and the second conductive via hole H2, to thereby connect between the first and second conductive via holes H1 and H2.

For this reason, the first ends 13-2, 22-2, and 23-2 and the second electrode patterns 13-3, 22-3, and 23-3 may be electrically connected with each other by the first conductive via hole H1, the second conductive via hole H2, and the wiring layer 41'.

Then, the first electrode terminal 1 electrically connecting the first electrode patterns 13-3, 22-3, and 23-3 to a predetermined circuit, such as a battery rectification circuit, may be formed above the second metal via hole H2.

In addition, the stacked resonant coil according to the preferred embodiment of the present invention may further include a first insulating layer 60 or a second insulating layer 70 on the wiring layer 41' to protect an exposed surface of the wiring layer 41' and prevent oxidation thereof.

The first insulating layer 60 may be formed by disposing a second adhesive 50 on the wiring layer 41' and disposing an insulating material such as polyimide (PI) on the second adhesive 50, followed by pressing.

The second insulating layer 70 may be formed by coating a solder resist (SR) such as a photoresist on the wiring layer 41'.

Meanwhile, although not shown in the drawing, the stacked resonant coil according to the preferred embodiment of the present invention may further include second electrode patterns (not shown) formed integrally with second ends (not shown) disposed outside the plurality of continuous closed loops of the coil patterns 13-1, 22-1, and 23-1, which are formed in the respective layers.

In addition, like the first and second conductive via holes H1 and H2, a third conductive via hole (not shown) for interlayer connection among the second electrode patterns of the respective layers may be formed by drilling a portion where the second electrode patterns of the respective layers are stacked, by a mechanical drilling process.

Then, a second electrode terminal 2 electrically connecting the second electrode patterns to a predetermined circuit such as a battery rectification circuit may be formed above the third conductive via hole.

FIGS. 4A to 4F are views for explaining a method of manufacturing the stacked resonant coil according to the preferred embodiment of the present invention.

Referring to FIGS. 4A to 4F, there are prepared a plurality of double-sided FCCLs (e.g., first and second double-sided FCCLs 10 and 20) where first copper foils 12 and 22 are stacked on first surfaces of insulating materials 11 and 21 such as polyimide (PI), respectively, and second copper foils 13 and 23 are stacked on second surfaces of the insulating materials 11 and 21, respectively.

Then, predetermined circuit layers 13', 22', and 23' are formed in one or both of the first copper foils 12 and 22 or the second copper foils 13 and 23 of the double-sided FCCLs 10 and 20, respectively.

Figure 4A:
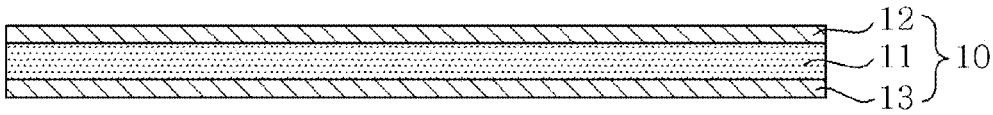
FIGS. 4A to 4F are views for explaining a method of manufacturing the stacked resonant coil according to the preferred embodiment of the present invention.
Figure 4B:
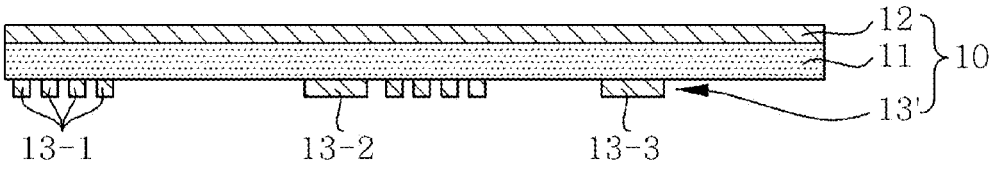
Figure 4C:
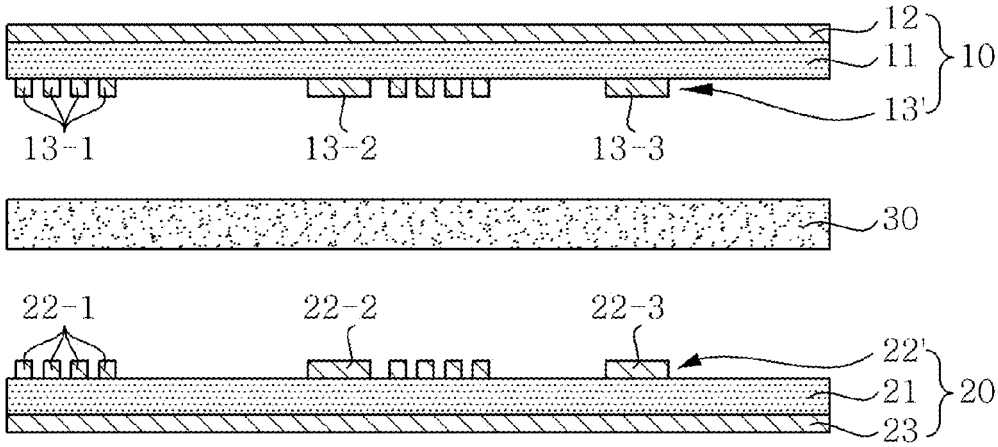
Figure 4D:
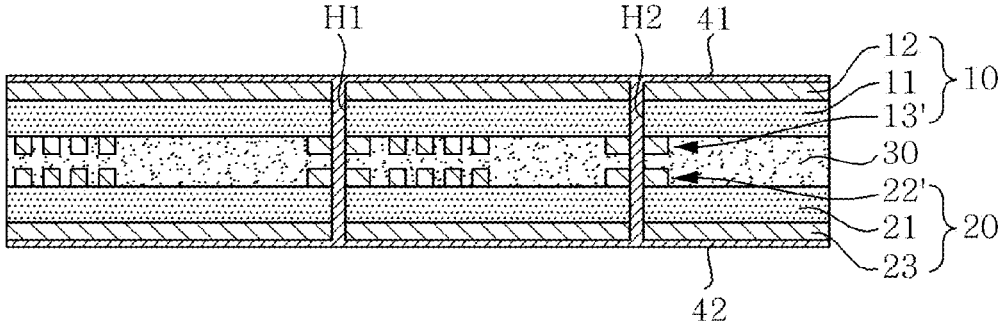

Specifically, as shown in FIGS. 4B and 4C, a first circuit layer 13' is formed in the second copper foil 13 of the first double-sided FCCL 10 while the first circuit layer 13' includes a coil pattern 13-1 constituted of a plurality of continuous closed loops, a first end 13-2 of the coil pattern 13-1, and a first electrode pattern 13-3.

In the same manner, a second circuit layer 22' is formed in the first copper foil 22 of the second double-sided FCCL 20 while the second circuit layer 22' includes a coil pattern 22-1 constituted of a plurality of continuous closed loops, a first end 22-3 of the coil pattern 22-1, and a first electrode pattern 22-3, correspondingly to the first circuit layer 13'.

In addition, the first and second circuit layers 13' and 22' may further include second electrode patterns (not shown) of the respective layers, which are formed integrally with second ends (not shown) of the coil patterns 13-1 and 22-1, respectively.

Here, third conductive via holes (not shown) for interlayer-connection between the second electrode patterns (not shown) of the respective layers may be formed.

Then, as shown in FIG. 4C, the first double-sided FCCL 10 having the first circuit layer 13' and the second double-sided FCCL 20 having the second circuit layer 22' are disposed with a first adhesive 30 therebetween such that the first and second circuit layers 13' and 22' correspond to each other, and then pressed.

As such, in a case where a plurality of double-sided FCCLs each having circuit layers formed on one surface or both surfaces thereof are used, coil patterns constituted of a plurality of closed loops can be easily stacked.

Then, a first conductive via hole H1 for interlayer connection of the first ends 13-2 and 22-2 formed in the circuit layers 13' and 22' and a second conductive via hole H2 for interlayer connection of the first electrode patterns 13-3 and 22-3 formed in the circuit layers 13' and 22' of the respective layers are formed in the stacked plurality of double-sided FCCLs 10 and 20.

These first and second conductive via holes H1 and H2 are plated through holes (PTHs), and may be formed through a mechanical drilling process.

Here, for performing the mechanical drilling process, for example, computerized numerical control (CNC) drilling may be employed.

After this drilling process, insides of the first and second conductive via holes H1 and H2 are plated.

So then, internal walls of the first and second conductive via holes H1 and H2 are plated, to thereby have conductivity. Alternatively, the first and second conductive via holes H1 and H2 may be filled with a conductive material, to thereby have conductivity.

With this, an external layer of the uppermost double-sided FCCL (e.g., the first copper foil 12 of the first double-sided FCCL 10) and an external layer of the lowermost double-sided FCCL (e.g., the second copper foil 23 of the second double-sided FCCL 20) of the stacked plurality of double-sided FCCLs are plated to thereby form first and second plating layers 41 and 42, respectively.

Figure 4E:
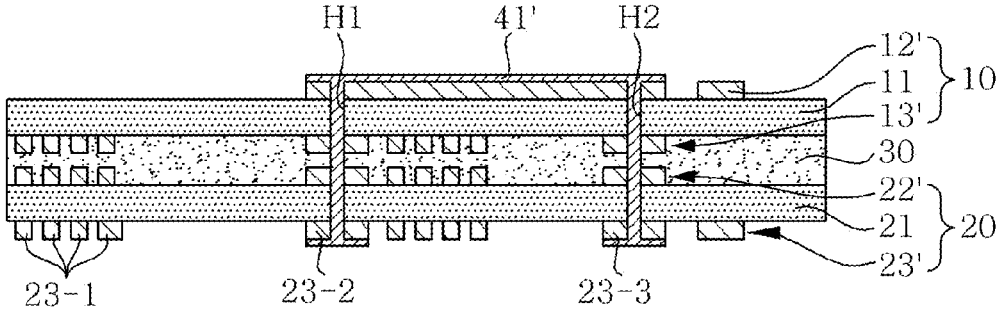

Then, as shown in FIG. 4E, in the stacked resonant coil according to the present invention, the first plating layer 41 and the external surface (for example, 12) of the uppermost double-sided FCCL are etched such that the first and second conductive via holes H1 and H2 are connected to each other, to thereby form a wiring layer 41' crossing from the first conductive via hole H1 to the second conductive via hole H2.

In addition, the second plating layer 42 and the external layer (for example, 23) of the lowermost double-sided FCCL may be selectively etched to thereby form a third circuit layer 23' including a coil pattern 23-1, and a first end 23-2 of the coil pattern 23-1, and a first electrode pattern 23-3.

Therefore, the first ends 13-2, 22-2, and 23-2 and the first electrode patterns 13-3, 22-3, and 23-3 of the respective layers may be electrically connected to each other through the first and second conductive via holes H1 and H2 and the wiring layer 41'.

Then, in order to protect the exposed circuits including the wiring layer 41' and prevent oxidation thereof, a coverlay process is performed to form a first or second insulating layer 60 or 70 on the exposed circuit including the wiring layer 41'.

This coverlay process is performed in order to protect and insulate the exposed surfaces of the etched circuit of the uppermost and lowermost double-sided FCCLs, and may be applied to fine circuits since heat-resistant adhesive strength, electric insulating property, flame-retardant property, flex-resistant property, and adhesive flowability are made uniform.

Specifically, the coverlay process may be largely performed in two kinds of manners.

Figure 4F:
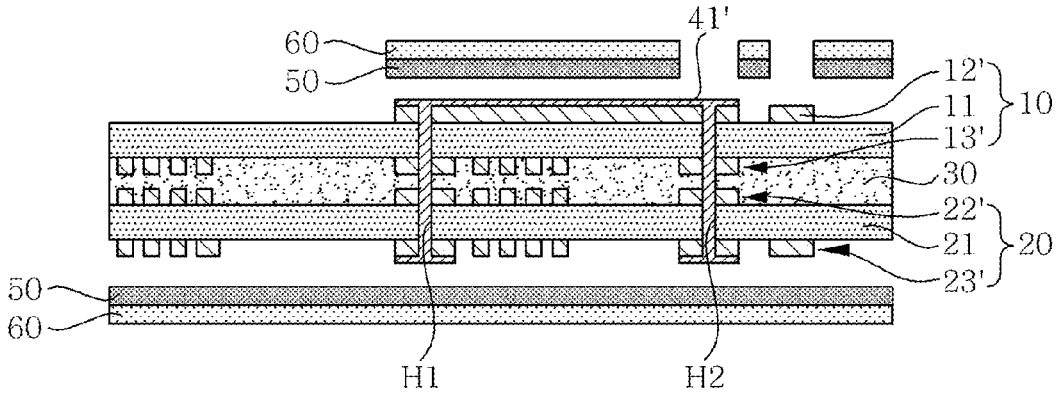

According to the first manner, the first insulating layer 60 may be formed by disposing a second adhesive 50 on the exposed circuit (e.g., the third circuit layer 23') of the lowermost double-sided FCCL 20 including the wiring layer 41', and disposing a predetermined insulating material thereon, followed by pressing, as shown in FIG. 4F.

Here, an insulating resin such as polyimide (PI) may be used for the insulating material.

This polyimide (PI) is excellent in heat resistant property because it can be used at a temperature up to 250° C., and properties thereof are less changed from a low temperature to a high temperature. Further, the polyimide has excellent impact-resistant property and good dimensional stability. In addition, the polyimide (PI) is excellent in electric properties, friction-resistant property, and flame-retardant property.

According to the second manner, the second insulating layer 70 may be formed by coating a solder resist (SR), as shown in FIG. 3.

Here, as the solder resist (SR), for example, a photoresist may be used.

This solder resist (SR), which is one of the insulating permanent coating materials, is a coating film covering the wiring layer 41' to thereby prevent unintended connection due to the soldering performed at the time of mounting components.

Therefore, the solder resist (SR) covers the wiring layer 41', to thereby shield a land needed for soldering of a component, that is, the rest portion excluding the surroundings of a portion where the component is to be mounted; prevents short-circuit, ground connection, corrosion, or contamination of circuits, and protects the circuit from external impact, moisture, and chemicals even after the stacked resonant coil is manufactured.

As described above, according to the method of manufacturing the sacked resonant coil of the present invention, it is possible to easily stack the resonant coils by using a plurality of double-sided FCCLs 10 and 20, and thus, the process can be simplified.

In addition, the conductive via holes H1 and H2 and the wiring layer 41', which are formed for electric connection between the first ends 13-2, 22-2, and 23-2 of the stacked resonant coil and the electrode terminal 1 formed above the first electrode patterns 13-3, 22-3, and 23-3, are formed not by a manual labor but by a PCB process, so that products having uniform performances and excellent quality can be mass-produced.

As set forth above, according to the present invention, a plurality of double-sided FCCLs are used to thereby facilitate stacking of the resonant coils, thereby simplifying the process.

Further, according to the present invention, the conductive via holes and the wiring layer, which are formed for electric connection between the ends of the stacked resonant coil and the electrode terminal, are formed not by a manual labor but by a PCB process, thereby improving mass-productivity of products having uniform performances and excellent quality.

Although the embodiments of the present invention have been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

What is claimed is:

1. A method of manufacturing a stacked resonant coil, the method comprising:

(A) forming circuit layers on a plurality of double-sided FCCLs, respectively, and then stacking the double-sided FCCLs respectively having the circuit layers formed thereon by using a first adhesive, each of the circuit layers including a coil pattern, first and second ends of the coil pattern, a first electrode pattern, and a second electrode pattern formed integrally with the second end;

(B) forming first and second conductive via holes in the stacked plurality of double-sided FCCLs, the first conductive via hole being for interlayer connection of the first ends respectively formed in the circuit layers and the second conductive via hole being for interlayer connection of the first electrode patterns respectively formed in the circuit layers; and (C) forming a wiring layer on an external layer of an uppermost double-sided FCCL in the staked plurality of double-sided FCCLs, the wiring layer connecting between the first and second conductive via holes for electrically connecting the first ends and the first electrode patterns.

2. The method as set forth in claim 1, wherein the stage (A) includes:

(A-1) etching a first surface of a first double-sided FCCL to form a first circuit layer including a coil pattern, first and second ends of the coil pattern, a first electrode pattern, and a second electrode pattern formed integrally with the second end;

(A-2) etching a second surface of a second double-sided FCCL to form a second circuit layer corresponding to the first circuit layer, the second circuit layer including a coil pattern, first and second ends of the coil pattern, a first electrode pattern, and a second electrode pattern formed integrally with the second end; and (A-3) disposing the first adhesive between the first and second circuit layers, followed by pressing.

3. The method as set forth in claim 1, wherein the stage (B) includes:

(B-1) forming the first conductive via hole for interlayer connection of the first ends respectively formed in the circuit layers of the stacked plurality of double-sided FCCLs; and (B-2) forming the second conductive via hole for interlayer connection of the first electrode patterns respectively formed in the circuit layers of the stacked plurality of double-sided FCCLs.

4. The method as set forth in claim 1, wherein the stage (C) includes:

(C-1) plating insides of the first and second conductive via holes;

(C-2) plating the external layer of the uppermost double-sided FCCL and an external layer of a lowermost double-sided FCCL in the stacked plurality of double-sided FCCLs, to thereby form first and second plating layers; and (C-3) etching the first plating layer and the external layer of the uppermost double-sided FCCL such that the first and second conductive via holes are connected to each other, to thereby form the wiring layer crossing from the first conductive via hole to the second conductive via hole.

5. The method as set forth in claim 4, wherein the stage (C) further includes (C-4) etching the second plating layer and the external layer of the lowermost FCCL to thereby form a circuit layer including a coil pattern, first and second ends of the coil pattern, a first electrode pattern, and a second electrode pattern formed integrally with the second end.

6. The method as set forth in claim 1, further comprising, (D) forming an insulating layer on the wiring layer, the insulating layer protecting the wiring layer and preventing oxidation of the wiring layer.

7. The method as set forth in claim 6, wherein the stage (D) includes, disposing a second adhesive on the wiring layer, and disposing an insulating material on the second adhesive layer, followed by pressing.

8. The method as set forth in claim 6, wherein the insulating material is polyimide.

9. The method as set forth in claim 6, wherein the stage (D) includes, coating a solder resist on the wiring layer.

10. The method as set forth in claim 9, wherein the solder resist is a photoresist.

11. The method as set forth in claim 1, wherein the first and second conductive via holes are formed by a mechanical drilling process.

12. The method as set forth in claim 11, wherein the mechanical drilling process is performed by computer numerical control drilling.

* * * * *